United States Patent [19]

Ruscitti et al.

[11] Patent Number: 4,511,064

[45] Date of Patent: Apr. 16, 1985

[54] VALVE AND CAP ASSEMBLY FOR DISPENSING FLUID MATERIALS UNDER PRESSURE WITH WARRANTY SEAL

[75] Inventors: Tomaso Ruscitti; Giovanni Albini; Roberto Torretta; Andrea Incerti Baldi, all of Milan, Italy

[73] Assignee: S.A.R. S.p.A., Chieti, Italy

[21] Appl. No.: 471,348

[22] Filed: Mar. 2, 1983

[30] Foreign Application Priority Data

Mar. 18, 1982 [IT] Italy ..... 21182/82[U]

[51] Int. Cl.[3] ..... B67B 5/00

[52] U.S. Cl. ..... 222/153; 222/402.13

[58] Field of Search ..... 222/153, 541, 402.1, 222/402.24, 402.13, 522, 524, 182, 402.11, 394

[56] References Cited

U.S. PATENT DOCUMENTS

| | | | |
|---|---|---|---|
| 3,270,924 | 9/1966 | Kitabayashi | 222/394 |
| 3,325,054 | 6/1967 | Braun | 222/153 X |
| 3,367,540 | 2/1968 | Lehmann | 222/541 X |
| 3,494,510 | 2/1970 | Rahn | 222/402.13 X |
| 3,865,283 | 2/1975 | Hayes | 222/402.11 |
| 3,977,576 | 8/1976 | Amabili | 222/402.1 |

FOREIGN PATENT DOCUMENTS 2211277 3/1972 Fed. Rep. of Germany ..... 222/522

*Primary Examiner*—Joseph J. Rolla
*Assistant Examiner*—Kenneth Noland
*Attorney, Agent, or Firm*—Oblon, Fisher, Spivak, McClelland & Maier

[57] ABSTRACT

The invention relates to a dispensing valve cap assembly for fluid materials under pressure with a warranty seal. The valve includes a body made of plastic material attachable within the inlet of a container for the material to be dispensed and the cap is passed through by a conduit opening at one end thereof into a seat for accommodating the free end of the valve stem, and at the other end thereof into an outlet nozzle for the material to be dispensed. The cap has integral therewith via breakable finger-like elements a skirt extending to the valve, and the valve body has projecting therefrom an inner cylindrical wall adjacent to the skirt and a tubular wall defining a cylindrical cavity with the valve stem and having at least one inward projecting rib. The stem accommodating seat is defined by an extension projecting from the cap and extending within the cylindrical cavity, the outer surface of the extension having at least one projecting portion thereof interfering with the rib to prevent the cap from being removed off of the stem.

1 Claim, 1 Drawing Figure

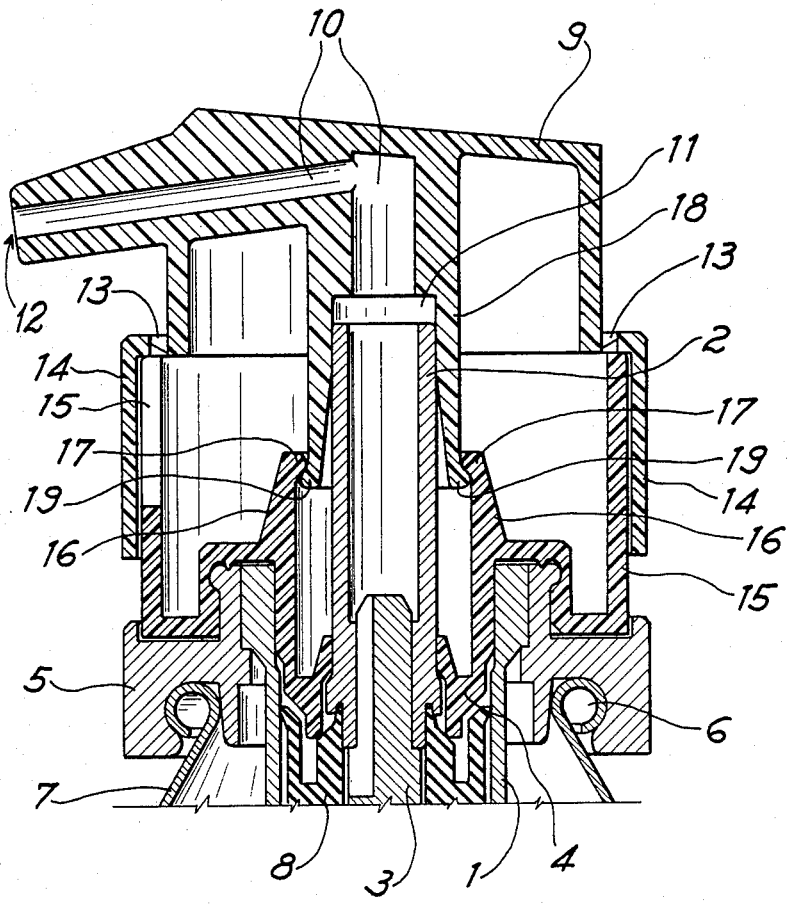
10
9
11
18
13
12
13
2
14
15
17
17
19
19
14
16
16
15
5
6
7
8
3
1
4

VALVE AND CAP ASSEMBLY FOR DISPENSING FLUID MATERIALS UNDER PRESSURE WITH WARRANTY SEAL

BACKGROUND OF THE INVENTION

1. Field of the Invention

This invention relates to an assembly comprising a valve and cap with warranty seal for use on containers of materials which can be dispensed under pressure and in atomized form.

2. Description of the Prior Art

It is well known that in order to prevent any fraudulent dispensing of fluid materials under pressure through caps applied on valve stems, in turn attached to the opening of containers for such materials, use is resorted to of warranty seals bonding the caps to the fixed body of the valves, inhibiting any operation thereof until the seals are broken.

However, systems of this known type have the disadvantage of a relatively high cost (particularly where the body, to which the seal is attached, is separate and distinct from the valve body and cap) and particularly in that the cap can be quite readily removed away from the valve stem, which can thus be operated without breaking the warranty seal, unless provision is made for a friction restraint of a substantial nature between said warranty seal and a body fixed to the valve, but in which case the assembling of the cap onto the valve is difficult and sometimes may cause the seal breakage.

SUMMARY OF THE INVENTION

It is the main object of the present invention to provide a valve and cap dispensing assembly of the above mentioned type, which is of low cost in production, is readily assembled and wherein said cap can be removed from the valve stem.

This and still further objects are achieved by a dispensing valve and cap assembly for fluid materials under pressure, wherein the assembly is provided with a warranty seal and the valve comprises a body of plastic material attachable to the inlet of a container for the material to be dispensed and wherein the cap is passed through by a conduit opening at one end thereof into a seat for accomodating the free end of the valve stem and at the other end thereof into an outlet nozzle for the material to be dispensed, a skirt being integral with the cap via breakable finger-like elements, this skirt extending to the valve, characterized in that said valve body has projecting therefrom an inner cylindrical wall adjacent said skirt and a tubular wall defining a cylindrical cavity with the valve stem and having at least one inwardly projecting rib, and that said stem accomodating seat is defined by an extension projecting from the cap and extending within said cylindrical cavity, the outer surface of said extension having at least one projecting portion thereof interferring with said rib preventing the cap from being removed away from said stem.

BRIEF DESCRIPTION OF THE PREFERRED EMBODIMENT

In order that the structure and features of a dispensing valve and cap assembly according to the present invention be more clearly understood, a preferred embodiment thereof will now be described with reference to the accompanying drawing, in which the single FIGURE is a schematic axial sectional view showing a valve having applied thereon a dispensing cap provided with warranty seal.

The structure of the valve forming part of the assembly herein claimed is per se insignificant, as it could be of any known type having a fixed body of plastic material which can be connected onto the inlet of a container for a fluid material to be dispensed under pressure. For instance, the valve could be of the type described in U.S. Pat. No. 3,187,960, 3,211,346, 3,500,761 and 4,113,145.

The valve shown in the accompanying drawing is substantially the same as that described in Italian patent application No. 19026 A/81 and corresponding English patent application No. 8138959 and German patent application No. P3151892.3. It comprises an elongated hollow body 1, having a hollow valve stem 2 movably extending therein, with a shaped guide element 3 integral with the lower end of the latter, the stem being held in the cavity of the hollow body 1 by a retaining element 4, which is restrained onto an anchoring element 5 carrying said hollow body 1 and which in turn is snap connected on the free edge 6 of a container 7 for a fluid material to be dispensed.

A movable gasket 8 is mounted on said stem and guide element 3, the gasket inhibiting or allowing the passage of the material under pressure within the cavity of stem 2 depending on the position taken by said gasket on the stem. The structure and operation of the valve body hitherto described will not be herein further disclosed as evident from the foregoing and as clearly shown in the above cited three patent applications.

The dispensing cap connected to the described valve is also of a mostly known structure. It comprises the body of the actual cap 9, passed through by a conduit 10 opening at one end thereof into a seat 11, in which the free end of stem 2 is accomodated, and is open at the other end thereof to form an outlet nozzle 12 for the material to be dispensed. A skirt 14 extending so as to overlap the valve is integral with said cap 9 by a series of breakable finger-like elements 13.

The novel and distinctive part of the previously described valve resides in that said retaining element 4 has projecting therefrom a cylindrical wall 15 internally of and adjacent said skirt 14, and a shaped tubular wall 16 defining a cylindrical cavity with the valve stem 2 and having at its free end an inwardly projecting continuous edge member 17. Said element 4, cylindrical wall 15 and tubular wall 16 are made of a single piece of molded plastic material.

The novel and distinctive part of the dispensing cap resides in that the cap seat 11 is defined by an elongated tubular extension 18 extending within the cavity defined by said tubular wall 16 and stem 2, and in that the outer surface of extension 18 has a ridge 19 interferring with said edge 17 and preventing the cap from being removed away from the valve.

Of course, the size of edge 17 and ridge 19 should be such that, when the described unit is assembled, by pressing the cap on the valve, the elastic deformation of the material would enable ridge 19 to pass beyond edge 17 and enter the space between stem 2 and tubular wall 16, that is to the position shown on the drawing, which is the rest position for the valve.

Under these conditions, the skirt 14 may also be in very light contact with wall 15, but its provision and integrity ensure that the material within container 7 cannot be dispensed.

For valve operation, the fingers of a hand are used to grip said skirt 14 and tear it off, thus breaking said finger-like elements 13. Thereupon, the cap can be freely downward pressed to cause the operation of the valve and exit of fluid material under pressure.

From the foregoing, it clearly appears that great simplicity in construction of the dispensing valve-cap assembly with an assured seal, reliability in operation and valve inviolability when skirt 14 is still integral with the cap body 9 is possible.

What is claimed is:

1. A dispensing valve and cap assembly for fluid materials under pressure for providing an assured seal, comprising:

a valve having a body made of plastic material attachable onto the inlet of a container for the material to be dispensed;

a cap which includes a conduit formed therein opening at a first end thereof into a seat for accomodating a free end of a valve stem, and at a second end thereof into an outlet nozzle for material to be dispensed, said cap having integrally formed therewith a skirt and a plurality of breakable finger-like elements interconnecting said cap with said skirt and extending so as to overlap an exterior portion of said valve, wherein said valve body further comprises an inner cylindrical wall adjacent said skirt and a tubular wall defining with the valve stem a cylindrical cavity, said tubular wall having at least one inwardly projecting edge member, and wherein said seat accomodating the free end of a valve stem is defined by an extension projecting from said cap and extending within said cylindrical cavity, an outer surface of said extension having at least one outwardly projecting ridge member engaging said inwardly projecting edge member to prevent said cap from being removed from said stem.

* * * * *